US006792240B2

(12) United States Patent
Shida et al.

(10) Patent No.: US 6,792,240 B2
(45) Date of Patent: Sep. 14, 2004

(54) IMAGE HEATING APPARATUS AND ELASTIC ROLLER THEREFOR

(75) Inventors: Tomonori Shida, Shizuoka (JP); Masahiro Suzuki, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/287,514

(22) Filed: Nov. 5, 2002

(65) Prior Publication Data

US 2003/0086737 A1 May 8, 2003

(30) Foreign Application Priority Data

Nov. 8, 2001 (JP) ..... 2001-342858
Oct. 23, 2002 (JP) ..... 2002-308071

(51) Int. Cl.[7] ..... G03G 15/20
(52) U.S. Cl. ..... 399/333; 399/328
(58) Field of Search ..... 399/320, 328, 399/329, 330, 331, 333, 339; 219/216

(56) References Cited

U.S. PATENT DOCUMENTS 5,546,173 A * 8/1996 Hinotani et al. ..... 399/331
5,689,788 A * 11/1997 Moser ..... 399/328
5,722,026 A 2/1998 Goto et al. ..... 399/333
5,926,680 A * 7/1999 Yamamoto et al. ..... 399/328
6,031,215 A * 2/2000 Nanataki et al. ..... 219/216
6,131,010 A 10/2000 Kume et al. ..... 399/333
6,144,832 A * 11/2000 Nimura et al. ..... 399/328
6,263,172 B1 7/2001 Suzuki et al. ..... 399/67
6,456,819 B1 9/2002 Abe et al. ..... 399/329
6,577,839 B2 * 6/2003 Samei ..... 399/328

FOREIGN PATENT DOCUMENTS

JP 9-126225 5/1997

* cited by examiner

*Primary Examiner*—Sandra L. Brase
(74) *Attorney, Agent, or Firm*—Fitzpatrick, Cella, Harper & Scinto

(57) ABSTRACT

The image forming apparatus includes an elastic roller for forming a nip portion for binding and conveying a recording material, the elastic roller including a elastic layer and a parting surface layer, wherein an area which is not passed by the recording material in the nip portion includes an exposed area where a elastic layer of the elastic roller is exposed, and wherein the exposed area includes a portion where a diameter of the exposed area is equal to or less than a maximum diameter of an area of the parting surface layer. The image forming apparatus prevents a rotary body or a pressuring body from contaminating their surfaces for a long time.

20 Claims, 9 Drawing Sheets

IMAGE HEATING APPARATUS AND ELASTIC ROLLER THEREFOR

BACKGROUND OF THE INVENTION

1. Field of the Invention

The present invention relates to an image heating apparatus adapted for use as a fixing device for an image forming apparatus such as a copying machine or a printer, and an elastic roller to be employed in such image heating apparatus.

2. Description of Related Art

In the image forming apparatus such as the copying machine or the printer, it is recently desired strongly to reduce the electric power consumption and to shorten a time required for completing a first print (first print time).

In one of the means for achieving such objects, one of paired rotary bodies constituting a fixing nip portion of a heat fixing device is made thinner (made flexible) to reduce the heat capacity. For example there are proposed a type in which a flexible rotary body is sandwiched between an oblong plate-shaped heater and a pressure roller and a recording material is passed between the flexible rotary body and the pressure roller to thermally fix an image on the recording material, and an induction heating type in which heat is generated by the flexible rotary body itself by electromagnetic induction instead of employing the plate-shaped heater.

In the image heating apparatus utilizing such flexible rotary body, there is often employed an elastic roller-driven type configuration in which an elastic roller (for example pressure roller) is driven and a flexible rotary body is rotated by the rotation of the elastic roller, because there can be realized a simple configuration of rotating a pair of rotary bodies which are composed of a flexible rotary body and an elastic roller.

In an apparatus of such elastic roller-driven apparatus, for example an apparatus employing a fixing film as the flexible rotary body and a pressure as the pressure roller, in case the pressure nip width and the pressurizing force increase between the fixing film and the pressure roller, a sliding resistance increases between the fixing film and a sliding member which is provided inside the fixing film to form a nip portion in cooperation with the pressure roller, whereby a larger driving force is required for the pressure roller.

In case the driving force for the pressure roller is insufficient, the driving force of the pressure roller is not sufficiently transmitted to the fixing film when the recording material passes between the fixing film and the pressure roller, whereby a slippage is generated between the pressure roller and the recording material, resulting in an unsatisfactory conveying thereof and eventually leading to a jamming.

Also for preventing a fixing offset phenomenon, a parting layer is generally formed on the surface of the fixing film and the pressure roller, but the aforementioned slippage tends to be generated in case the surface layer of the pressure roller is formed with tetrafluoroethylene-perfluoroalkylvinylether copolymer (PFA) excellent in durability and parting property.

Japanese Patent Application Laid-open No. 9-126225 (U.S. Pat. No. 5,722,026) provides a fixing apparatus in which the friction coefficient of the surface layer of the pressure roller is elevated by mixing a resin of a high friction coefficient in the fluorinated resin constituting the surface layer of the pressure or forming a coarse surface in the surface layer of a sheet non-passing area, thereby increasing the conveying force of the fixing film. In such method, however, a larger surface coarseness may result in a smear on the pressure roller or may reduce the strength of the surface layer, thereby leading to an insufficient durability. Also in case the surface layer is made coarse only in the sheet non-passing area only, the numerical range of the surface coarseness required for the practical use is too narrow and not practical.

SUMMARY OF THE INVENTION

It is an object of the present invention to provide an image forming apparatus to prevent a rotary body or a pressuring body from contaminating their surfaces for a long time.

Another object of the present invention is to provide an image forming apparatus for heating an image formed on a recording material, comprising:

a flexible rotary body;

a sliding member, provided in the flexible rotary body, for contacting the rotary body; and an elastic roller for forming a nip portion for binding and conveying the recording material, in cooperation with the sliding member across the rotary body, the elastic roller being provided with an elastic layer and a parting surface layer, wherein an area which is not passed by the recording material in the nip portion includes an exposed area where the elastic layer of the elastic roller is exposed, and wherein the exposed area includes a portion where a diameter of the exposed area is equal to or less than a maximum diameter of an area of the parting surface layer.

Another object of the present invention is to provide an image heating apparatus for heating an image formed on a recording material, the apparatus including:

a flexible rotary body;

a sliding member, provided in the flexible rotary body, for contacting the flexible rotary body; and an elastic roller for forming a nip portion for binding and conveying the recording material, in cooperation with the sliding member across the rotary body, the elastic roller being provided with an elastic layer and a parting surface layer;

wherein an area which is not passed by the recording material in the nip portion includes an exposed area where the elastic layer of the elastic roller is exposed, and the exposed area includes a portion where a diameter gradually increases toward an end portion of the elastic roller.

Another object of the present invention is provide an elastic roller including:

an elastic layer; and a parting surface layer;

wherein an end portion of the elastic roller in the axial direction includes an area where the elastic layer is exposed, and the exposed area includes a portion where the diameter gradually increases toward an end portion of the elastic roller.

Still other objects of the present invention will become fully apparent from the following detailed description which is to be taken in conjunction with the accompanying drawings.

DETAILED DESCRIPTION OF THE PREFERRED EMBODIMENTS

In the following the present invention will be described by embodiments thereof with reference to the accompanying drawings.

(First Embodiment)

At first there will be explained a first embodiment of the present invention.

Initially there will be given a brief explanation on an image forming process in an image forming apparatus in which an image forming apparatus of the present embodiment is mounted.

Figure 1:
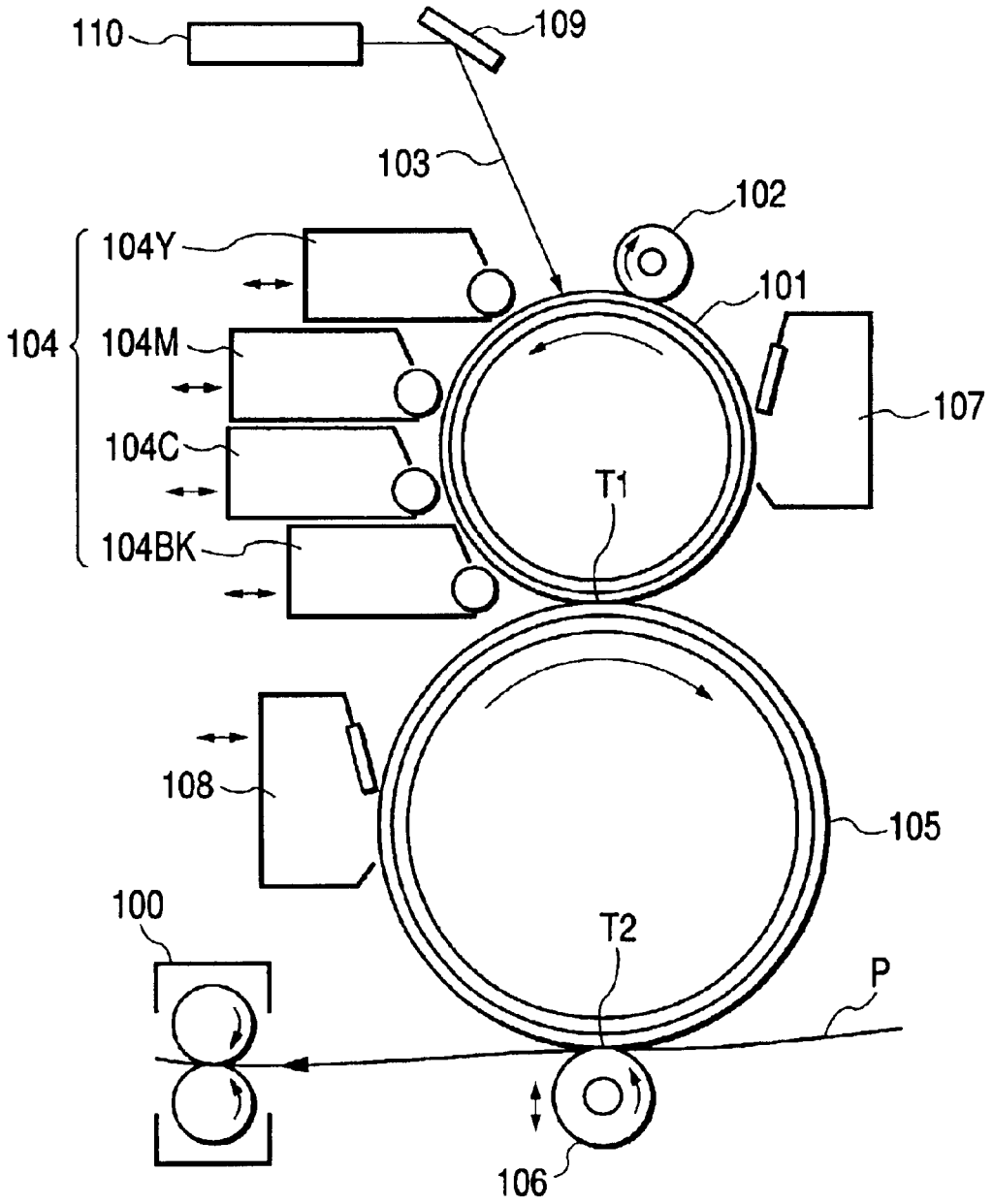
FIG. 1 is a schematic cross-sectional view showing the configuration of an image forming apparatus in which an image heating apparatus of the present invention is mounted.

FIG. 1 is a schematic view showing the configuration of an image forming apparatus. The image forming apparatus of the present embodiment is an electrophotographic color printer.

As shown in FIG. 1, a photosensitive drum 101 constituting a latent image bearing body composed of an organic photosensitive body or an amorphous silicon photosensitive body is at first uniformly charged with a charging roller 102. Then a laser beam, modulated according to an image signal, is emitted from a laser optical casing 110 and irradiates, via a mirror 109, the photosensitive drum 101 to form an electrostatic latent image thereon.

The electrostatic latent image on the photosensitive drum 101 is rendered visible by toner supplied from a developing device 105. The developing device 104 is composed of four units of yellow Y, magenta M, cyan C and black Bk and develops the latent image on the photosensitive drum 101 for each color, and the toner images are superposed in succession on an intermediate transfer drum 105 to obtain a color image. The intermediate transfer drum 105 is provided with an elastic layer of a medium electrical resistance and a surface layer of a high resistance on a metal drum. The metal drum is given a bias potential to generate a potential difference to the photosensitive drum 101, whereby the toner image on the photosensitive drum 101 is transferred onto the intermediate transfer drum.

On the other hand, a recording material P, supplied by a feed roller (not shown) from a sheet cassette (not shown), is fed between a transfer roller 106 and the intermediate transfer drum 105 so as to be synchronized with the toner images suerposed on the intermediate transfer drum 105.

The transfer roller 106 supplies a charge of a polarity opposite to a charge of the toner from the rear surface of the recording material P, thereby transferring the toner image t on the intermediate transfer drum 105 onto the recording material.

Then the recording material, having received the transfer of the toner image t, is subjected to a heat fixing treatment for the unfixed toner image in a fixing apparatus 100 composed of the image heating apparatus provided in the image forming apparatus, and is discharged as a color image bearing product to a discharge tray (not shown) provided outside the apparatus.

In the following there will be given a detailed description on the fixing apparatus 100 constituted by the image heating apparatus of the present invention.

Figure 2:
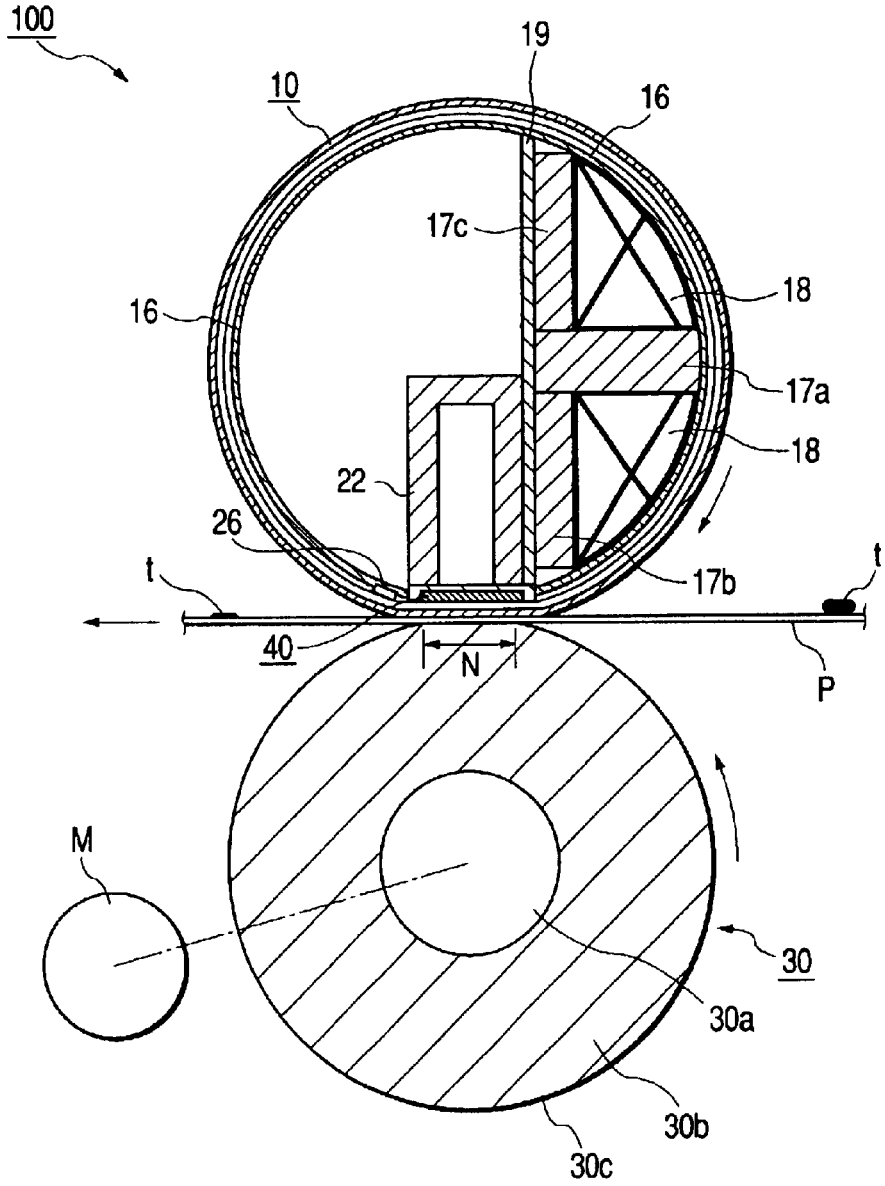
FIG. 2 is a schematic cross-sectional view showing the configuration of a fixing apparatus composed of an image heating apparatus of a first embodiment.

FIG. 2 is a schematic cross-sectional view showing the configuration of principal portions of the fixing apparatus 100. In the present embodiment, the fixing apparatus 100 is an apparatus of electromagnetic induction heating type.

As shown in FIG. 2, the fixing apparatus 100 is provided with a fixing film 10 constituting a flexible rotary body, a film guide member 16 constituting a support member, a pressure roller 30 constituting an elastic roller, and magnetic flux generating means formed by a magnetic core 17 and an excitation coil 18.

The magnetic core 17 is a member of a high magnetic permeability, preferably composed of a material employed in a core of a transformer such as ferrite or permalloy, more preferably ferrite showing a limited loss even at 100 kHz or higher.

The excitation coil 18 employs a bundle of plural thin copper wires, respectively insulation coated, as a wire for constituting a coil, and is formed by winding such bundled wires in plural turns. In the present embodiment, the excitation coil 18 is formed by 12 turns.

The insulation coating mentioned above is preferably heat resistant in consideration of the conduction of the heat generated by the fixing film 10. In the present embodiment, there is employed a polyimide coating of a heat resistant temperature of 220° C. The excitation coil 18 may be pressed from the exterior to increase the wire concentration.

The film guide member 16 also serves as an insulation plate for insulation between the magnetic core 17 and a pressurizing rigid stay 22. The film guide member 16 is preferably formed with a material of a high insulating property and a high thermal resistance. For example it may be selected from phenolic resin, fluorinated resin, polyimide resin, polyamide resin, polyamidimide resin, PEEK resin, PES resin, PPS resin, PFA resin, PTFE resin, FEP resin, LCP resin etc.

Electric power supplying portions 18*a*, 18*b* of the excitation coil 18 are connected to an excitation circuit 27 (FIG.

5). The excitation circuit 27 is rendered capable of generating a high frequency of 20 to 500 kHz by a switching power supply.

The excitation coil 18 generates an alternating magnetic flux by an AC current (high frequency current) supplied from the excitation circuit 27.

Figure 6:
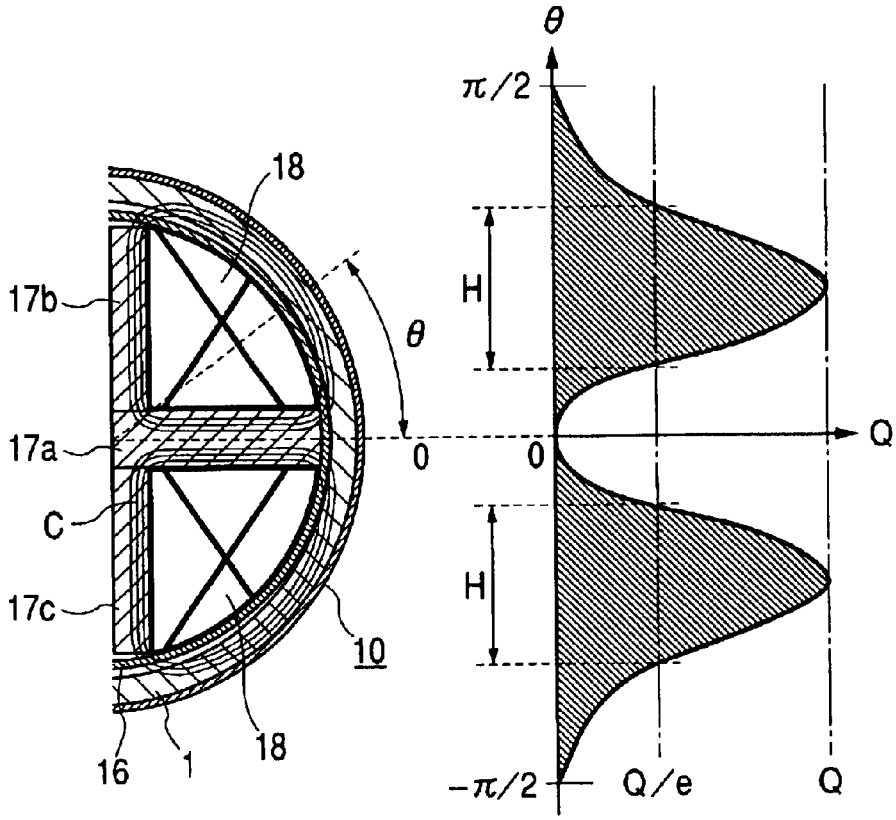
FIG. 6 is a view showing magnetic flux generation means and a relationship of a heat generation amount Q in a circumferential position thereof.

FIG. 6 schematically shows the mode of generation of the alternating magnetic flux by the excitation coil 18. A magnetic flux C shows a part of the alternating magnetic flux generated by the excitation coil 18.

The alternating magnetic flux (C) guided by the magnetic core 17 generates an eddy current in a heat generating layer 1 capable of electromagnetic inductive heat generation in the fixing film 10. Such eddy current generates Joule's heat (eddy current loss) in the heat generating layer 1 by the intrinsic resistance of the heat generating layer 1. The generated heat amount Q is determined by the density of the magnetic flux passing through the heat generating layer 1, and has a distribution as shown in a chart in FIG. 6. The ordinate indicates the heat generation amount Q in the heat generating layer 1 of the fixing film 10. A heat generating area H is defined as an area in which the heat generation amount is equal to or larger than Q/e where Q is the maximum heat generation amount. This is an area where a heat generation amount required for fixing can be obtained.

The temperature of the fixing nip portion N is regulated to maintain a predetermined temperature by a control of current supply to the excitation coil 18 by a temperature control system including a temperature sensor 26 such as a thermistor for detecting the temperature of the fixing film 10. In the present embodiment, the temperature of the fixing nip portion N is controlled, based on the temperature information of the fixing film 10 measured by the temperature sensor 26.

Figure 3:
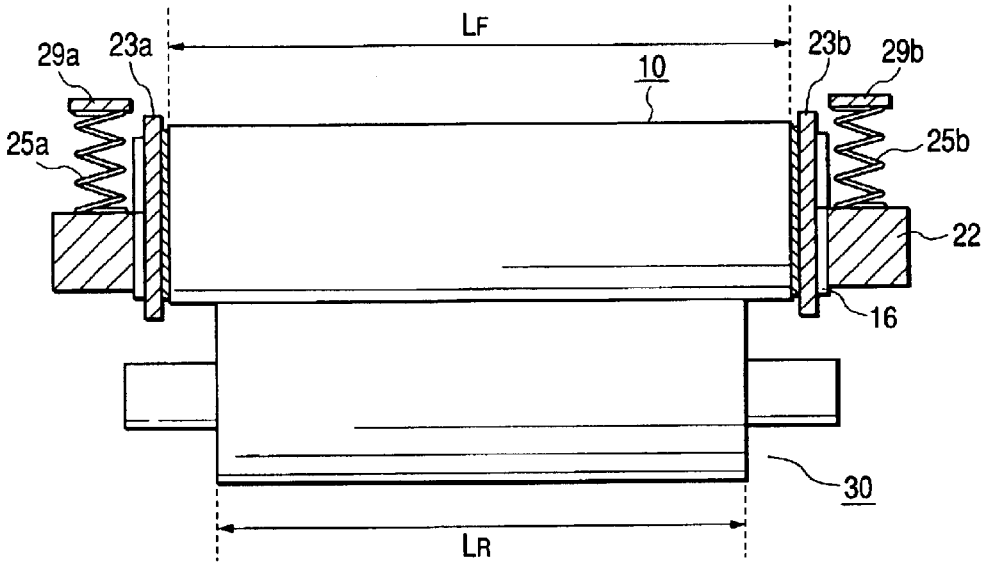
FIG. 3 is a front view of the image heating apparatus shown in FIG. 2.
Figure 4:
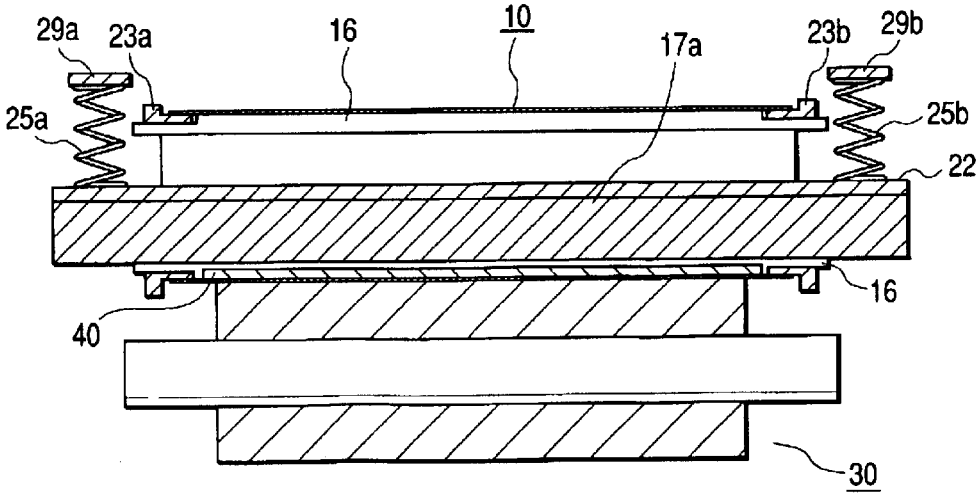
FIG. 4 is a frontal cross-sectional view of the image heating apparatus shown in FIG. 2.
Figure 5:
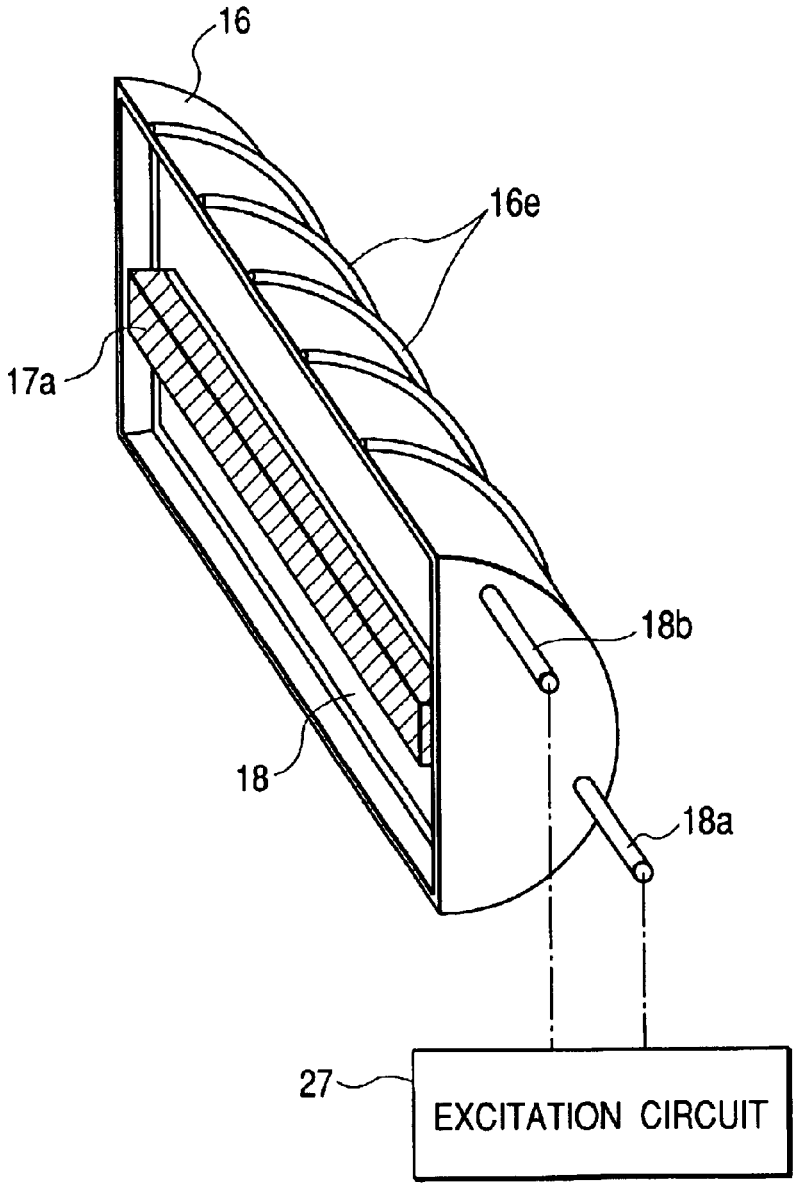
FIG. 5 is a schematic view showing the configuration of magnetic flux generation means in the first embodiment of the present invention.

FIG. 3 is a schematic front view of principal parts of the fixing apparatus 100 of the present embodiment, and FIG. 4 is a schematic frontal cross-sectional view thereof.

Pressurizing springs 25*a*, 25*b* are provided in a compressed state respectively between both ends of a pressurizing rigid stay 22 and spring-receiving members 29*a*, 29*b* of a chassis of the apparatus, thereby applying a pressing-down force to the pressurizing rigid stay 22. In this manner a lower surface or a sliding surface of the film guide member 16 and an upper surface of the pressure roller 30 are mutually pressed across the fixing film 10 thereby forming the fixing nip portion N constituting a nip area of a predetermined width.

In a state where the pressure roller 30 is driven in rotary motion whereby the fixing film 10 is driven in rotary motion, the fixing film 10 generates heat by electromagnetic induction by the power supply from the excitation circuit 27 to the excitation coil 18 and the fixing nip portion N is heated to and regulated at the predetermined temperature, a recording material P bearing an unfixed toner image t, which is an image formed by a developer, is introduced between the fixing film 10 and the pressure roller 30 in the fixing nip portion N with an image bearing surface upward, namely opposed to the surface of the fixing film, and, in the fixing nip portion N, the image bearing surface is in close contact with an external surface of the fixing film and is pinched and conveyed, together with the fixing film 10, in the fixing nip portion N. In the course of pinching and conveying of the recording material P together with the fixing film 10 in the fixing nip portion N, the unfixed toner image t on the recording material P is thermally fixed thereto by the heat of the fixing film 10. The recording material P, after passing the fixing nip portion N, is separated from the external surface of the rotating fixing film 10 and is conveyed for discharge. The heated and fixed toner image on the recording material is cooled, after passing the fixing nip portion, to form a permanent fixed image.

Flange members 23*a*, 23*b* receive edges of the fixing film in the axial direction during the rotation of the fixing film 10, thereby limiting a lateral displacement of the fixing film 10 in the longitudinal direction of the film guide member 16. The flange members 23*a*, 23*b* may be made rotatable, and driven by the fixing film 10.

Figure 7:
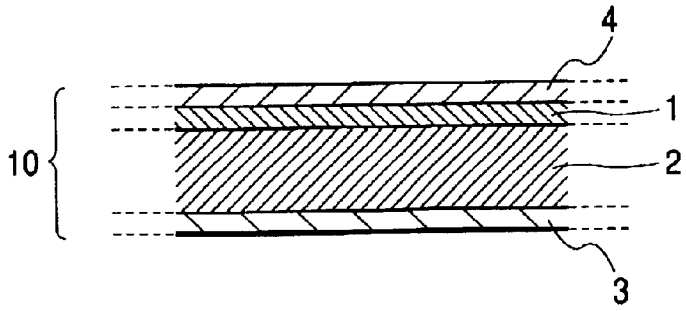
FIG. 7 is a view showing a layered structure of a flexible rotary body (fixing film) in the first embodiment of the present invention.

FIG. 7 is a schematic view showing a layered structure of the fixing film 10 in the present embodiment.

The fixing film 10 of the present embodiment has a composite structure including a heat generating layer formed by a metal film or the like and constituting a base layer of the fixing film 10 capable of heat generation by electromagnetic induction, an elastic layer 2 provided on the external surface of the heat generating layer 1, a parting layer 3 provided on the external surface of the elastic layer 2, and a sliding layer provided on the internal surface of the heat generating layer 1. The parting layer 3 is positioned at the surface side of the pressure roller and the sliding layer 4 is positioned at the surface side of the film guide. A primer layer (not shown) may be provided between the layers, in order to increase adhesion between the heat generating layer 1 and the elastic layer 2, between the elastic layer 2 and the parting layer 3 and/or between the heat generating layer 1 and the sliding layer 4. In the fixing film 10, the sliding layer 4 constitutes the internal surface and the parting layer 3 constitutes the external surface. As explained in the foregoing, an alternating magnetic flux applied to the heat generating layer 1 generates an eddy current therein, thereby generating heat in the heat generating layer 1. Such heat is transmitted through the elastic layer 2 and the parting layer 3 to heat the fixing film 10, thereby heating the recording material passed through the fixing nip portion N and achieve heat fixation of the toner image.

The heat generating layer may be formed by a non-magnetic metal, but is preferably formed by a ferromagnetic metal capable of sufficiently absorbing the magnetic flux, such as nickel, iron, ferromagnetic stainless steel or a nickel-cobalt alloy.

Also the thickness of the heat generating layer 1 is preferably larger than a surface film depth represented by a following equation and not more than 200 $\mu$m. The surface film depth $\sigma$ [m] is given by:

$$\sigma=503\times(\rho/f\mu)^{1/2}$$

utilizing a frequency $\mu$ [Hz] of the excitation circuit, a magnetic permeability $\mu$ and an intrinsic resistivity $\rho$ [$\chi$m].

Figure 8:
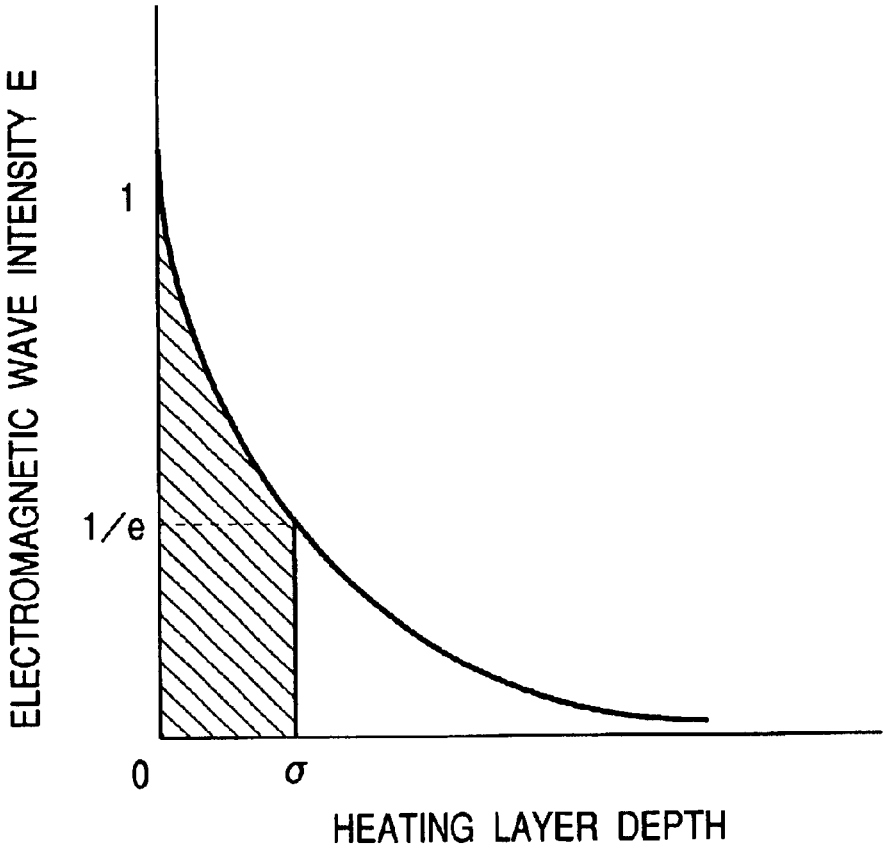
FIG. 8 is a chart showing the relationship between a depth of a heat generating layer of a rotary body and an intensity of an electromagnetic wave from magnetic flux generating means.

The foregoing equation indicates the depth of absorption of the electromagnetic wave used in the electromagnetic induction, and the intensity of the electromagnetic wave is equal to or less than 1/e in a deeper position, or, stated otherwise, the energy is mostly absorbed to such depth (cf. FIG. 8).

Also, the thickness of the heat generating layer 1 is preferably within a range of 1 to 100 $\mu$m. In case the thickness of the heat generating layer 1 is less than 1 $\mu$m, the efficiency is deteriorated since the electromagnetic energy cannot be mostly absorbed. On the other hand, in case the thickness of the heat generating layer 1 is in excess of 100 $\mu$m, the rigidity becomes excessively high and the bendability becomes poor, impractical for use in a rotary member. Therefore it is preferred that the thickness of the heat generating layer 1 is within a range of 1 to 100 $\mu$m.

The elastic layer 2 is preferably formed by a material of satisfactory heat resistance and a satisfactory thermal conductivity, such as silicone rubber, fluorinated rubber or fluorosilicone rubber.

The elastic layer 2 preferably has a thickness within a range of 10 to 500 μm, which is required for assuring the quality of the fixed image.

In case of printing a color image, particularly a photographic image or the like, a solid image is formed over a wire area on the recording material P. In such situation, in case the heating surface (parting layer 3) cannot adapt to the surface irregularities of the recording material or of the toner layer, the heating becomes uneven to generate an unevenness in the gloss between a portion with a larger heat conduction and a portion with a smaller heat conduction. A portion with a larger heat conduction shows a high glossiness, while a portion with a smaller heat conduction shows a low glossiness. The elastic layer with a thickness less than 10 μm is unable to following the irregularities of the recording material or the toner layer, thus resulting in an unevenness in the gloss of the image. On the other hand, in case the elastic layer 2 has a thickness equal to or larger than 1000 μm, the thermal resistance of the elastic layer becomes high and it becomes difficult to realize a quick starting property. More preferably the thickness of the elastic layer 2 is within a range from 50 to 500 μm.

The elastic layer 2, if excessively hard, is unable to adapt to the irregularities of the recording material or the toner layer, thereby resulting in an unevenness in the gloss of the image. Therefore, the hardness of the elastic layer 2 is preferably 60° (JIS-A hardness) or less, more preferably 45° (JIS-A hardness) or less.

The elastic layer preferably has a thermal conductivity λ within a range of:

$2.5\times10^{-3}$ to $8.4\times10^{-3}$[W/cm·° C.].

In case the thermal conductivity λ of the elastic layer 2 is less than $2.5\times10^{-3}$ [W/cm·° C.], the thermal resistance becomes high so that the temperature elevation on the surface layer (parting layer 3) of the fixing film becomes slow. On the other hand, in case the thermal conductivity λ of the elastic layer 2 is larger than $8.4\times10^{-3}$ [W/cm·° C.], there will result an excessively high hardness or an enhanced permanent compression strain.

Consequently, the thermal conductivity λ of the elastic layer is preferably within a range of $2.5\times10^{-3}$ to $8.4\times10^{-3}$ [W/cm·° C.], more preferably $3.3\times10^{-3}$ to $6.3\times10^{-3}$[W/cm·° C.].

The parting layer 3 is formed by a material of satisfactory parting property and heat resistance, selected for example from fluorinated resin, silicone resin, fluorosilicone resin, fluorinated rubber, silicone rubber, PFA, PTFE and FEP. In the present embodiment, PFA resin is employed in the parting layer.

The parting layer 3 preferably has a thickness within a range of 1 to 100 μm. A thickness less than 1 μm leads to an uneven coated film, resulting in drawbacks such as formation of a portion with insufficient parting property or an insufficient durability. On the other hand, a thickness exceeding 100 μm leads to a drawback of deterioration of thermal conduction, and, in case of a resin-based parting layer, an excessively high hardness which annuls the effect of the elastic layer.

In the configuration of the fixing film 10, as shown in FIG. 7, the sliding layer 4 is provided on a side of the heat generating layer 1, opposite to the side of the elastic layer 2. The sliding layer 4 is preferably formed by a resin having a high slidability and a high heat resistance, such as fluorinated resin, polyimide resin, polyamide resin, apolyamidimide resin, PEEK resin, PES resin, PPS resin, PFA resin, PTFE resin, or FEP resin. The presence of the sliding layer 4 not only suppresses the rotary driving torque (torque on the axis of the pressure roller as a driving roller) in an initial period of the use of the fixing apparatus 100 but also prevents the abrasion of the heat generating layer of the fixing film 10, thereby suppressing the increase of the rotary driving torque of the fixing apparatus 100 even after a prolonged use. Also the sliding layer 4 has an effect of heat insulation, preventing the heat generated in the heat generating layer 1 from being directed toward the internal side of the fixing film, thereby improving the efficiency of heat supply to the recording material P, in comparison with a case without the sliding layer 4 and thus suppressing the electric power consumption.

The thickness of the sliding layer 4 is preferably within a range of 10 to 1000 μm. In case the thickness of the sliding layer 4 is less than 10 μm, the durability becomes insufficient and the heat insulating property is also limited. On the other hand, in case the thickness of the sliding layer 4 exceeds 1000 μm, the distance from the magnetic core 17 and the excitation coil 18 to the heat generating layer 1 becomes large, so that the magnetic flux cannot be sufficiently absorbed by the heat generating layer 1.

The pressure roller 30 is rotated by drive means M counterclockwise as indicated by an arrow. A frictional force between the pressure roller 30 and the fixing film 10 under the rotary drive of the pressure roller 30 applies a rotating force to the fixing film 10, whereby the fixing film 10 rotates clockwise, with the internal surface thereof sliding on the lower sliding surface of the film guide member 16 in the fixing nip portion N, around the film guide member 16 with a peripheral speed approximately corresponding to the rotating speed of the pressure roller 30.

On the sliding faces of the film guide member 16 and the fixing film 10, there may be provided a sliding member 40 of a high sliding ability, constructed separately from the film guide member 16. It is also possible to employ a material of a high sliding ability for the film guide member 16 and to construct the sliding surface and the film guide member 16 as an integral member, thereby using the film guide member itself as the sliding member. In the present embodiment, there is employed a sliding member 40.

Figure 9:
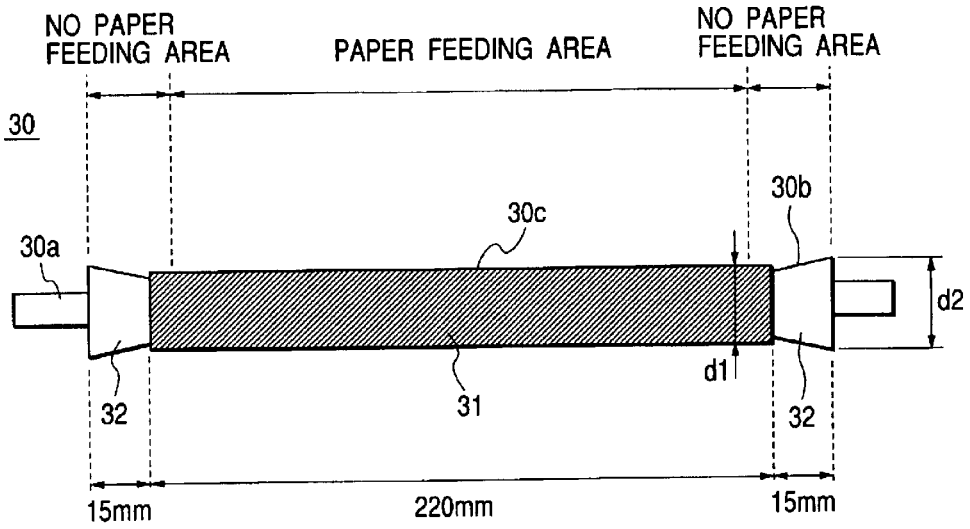
FIG. 9 is a schematic elevation view showing the configuration of an elastic roller (pressure roller) in the first embodiment of the present invention, in a state where a parting surface layer is provided on an elastic layer.
Figure 12:
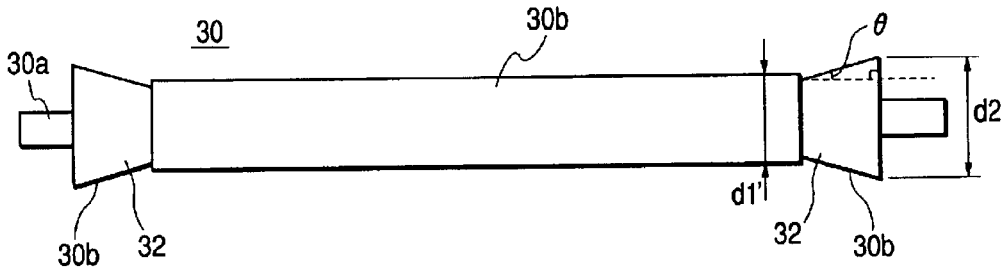
FIG. 12 is a schematic elevation view showing the configuration of an elastic roller (pressure roller) in the first embodiment of the present invention, in a state not covered by a parting surface layer.

In the following there will be given a detailed explanation, with reference to FIGS. 9 and 12, on the pressure roller 30 to be employed in the fixing apparatus 100 of the present embodiment. FIG. 9 shows a state in which the elastic layer is covered by the parting surface layer and FIG. 12 shows a state in which the parting surface layer is removed.

The pressure roller 30 is formed, on an iron metal core 30*a* of an external diameter of 14 mm, by forming an elastomer layer 30*b* composed of a silicone rubber layer of a thickness of 3 mm on the external periphery of the metal core and forming a parting surface layer 30*c* on the elastomer layer 30*b* in a longitudinal area (in the axial direction) where the recording material passes. For the parting layer 30*c*, there is selected a material of satisfactory heat resistance such as fluorinated resin. In the present embodiment, the parting layer is formed by a PFA tube of a thickness of 70 μm. Within a sheet non-passing area in the axial direction of the pressure roller 30 not coming into contact with the recording material at the thermal processing, the surface of the pressure roller 30 is not provided, in an elastomer layer exposed portion 32, with the parting layer but the silicone rubber constituting the elastomer layer 30*b* is exposed. The length of the elastomer laser exposed portion 32 in the axial direction may be at maximum equal to the entire sheet non-passing area, but, it is desirable that the parting layer portion 31 is extended to the sheet non-passing area with a certain margin of at least 1 mm, since the elastomer layer exposed portion 32 is more easily smeared than the parting layer portion 31 and has a friction coefficient larger than in the parting layer portion 31 whereby the sheet conveying becomes unstable in case the sheet is displaced from the normal position.

In the pressure roller 30, the maximum value of the external diameter of the elastoner layer exposed portion 32 is equal to or larger than the maximum value of the external diameter of a portion 31 of the pressure roller 30 having the parting layer (hereinafter preferred to as parting layer portion). Even if the maximum value of the external diameter of the elastomer layer exposed portion 32 is somewhat smaller than the maximum value of the external diameter of the parting layer portion 31, the elastomer layer exposed portion can contact the fixing film since a pressure is applied between the pressure roller and the sliding member. In such case, however, because of the smaller diameter than in the parting layer portion, it has a lower peripheral speed. Because the elastomer layer exposed portion has a lower peripheral speed and a higher friction coefficient than in the parting layer portion, the fixing film tends to rotate at the peripheral speed of the elastomer layer exposed portion, which is lower than the peripheral speed of the parting layer portion. For this reason, in case of conveying an ordinary recording material, the elastomer layer exposed portion 32 exerts a braking effect, leading to troubles such as sheet jamming or creases on the sheet.

On the other hand, an image defect may be similarly induced also in case the external diameter of the elastomer layer exposed portion 32 is excessively larger than the maximum value of the external diameter of the parting layer portion 31 of the pressure roller 30. Therefore, there is preferred a condition:

$$0 \leqq (d2-d1)/d1 \leqq 0.2$$

wherein d1 is the maximum value of the external diameter of the parting layer portion 31, and d2 is the maximum value of the external diameter of the elastomer layer exposed portion 32.

In the present embodiment, there are adopted d1=ϕ20 and d2=ϕ20.325 for designing. Also the maximum diameter d1' in a state without the parting surface layer is ϕ19.86 since the thickness of the PFA tube is 70 μm. Also the silicone rubber layer in the area with the parting surface layer and that in the exposed area may be formed integrally or may be formed separately and connected by adhesion.

The elastomer layer exposed portion 32 is also provided with a tapered portion in which the external diameter increases from an inner side of the pressure roller toward an end portion of the pressure roller in the axial direction thereof.

Figure 10:
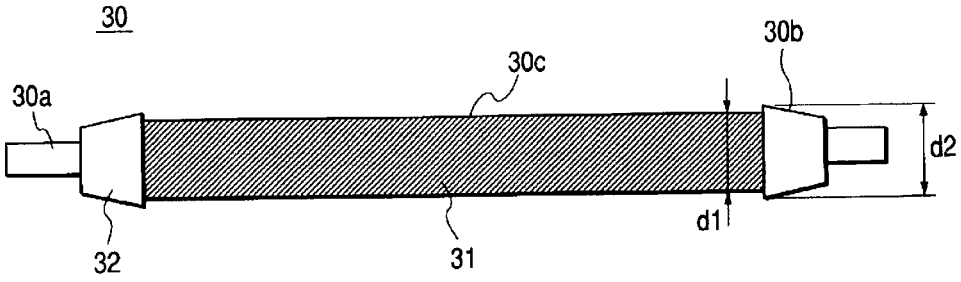
FIG. 10 is a schematic elevation view showing the configuration of a pressure roller as a comparative example to the first embodiment of the present invention.

In case, as shown in FIG. 10, the elastomer layer exposed portion 32 has a maximum external diameter at the innermost side in the axial direction of the pressure roller 30 and has a large difference in the external diameter at the interface with the parting layer portion 31, there may result a pressure loss at an end portion of the parting layer portion 31, thus leading to an insufficient fixation. In order to avoid such situation, it becomes necessary to extend the pressure roller 30 in the longitudinal direction thereof or to reduce the tolerance of a step difference between the elastomer layer exposed portion 32 and the parting layer portion 31, thereby leading to an undesirabe cost increase.

In the present embodiment, in view of facilitating the manufacture and widening the tolerance, the parting layer portion 31 is formed in a tapered shape in which the external diameter monotonously increases from the inner side to the end portion in the longitudinal direction of the pressure roller, as shown in FIG. 9. Also the tapered portion preferably satisfies a condition $0<\tan\theta<0.1$ as shown in FIG. 12. Such condition provides an advantage that the driving force for the fixing film in the sheet non-passing area can be easily maintained with an appropriate range.

In the present embodiment, the elastomer layer **30*b* of the pressure roller 30 is composed of silicone rubber, but there may also be employed heat resistant fluorinated rubber or fluorinated resin. The hardness of the rubber alone is preferably within a range of 10° to 40° in Asker-C hardness (under a load of 9.8 N), and the hardness of the product in the molded state of the pressure roller 30 is preferably within a range of 40° to 70° in Asker-C hardness (under a load of 9.8 N) in the parting layer portion and 25° to 60° in the elastomer layer exposed portion 32**.

In case the rubber hardness is excessively low, the rubber escapes in the elastomer layer exposed portion 32 whereby the conveying power becomes insufficient and the conveying of the fixing film becomes impossible. Also depending on the selected rubber and the level of crosslinking thereof, there may result significant deterioration under the application of heat or pressure. Furthermore, in case of preparing a pressure roller of a desired product hardness with a low rubber hardness in the parting layer portion 31, it becomes necessary to regulate the hardness by the material and the thickness of the parting layer **30*c*** constituting the surface layer. For example in case of employing PFA with an increased thickness, the roller loses the flexibility and shows an inferior adaptability to the recording material. In a pressure roller with an excessively low product hardness, the fixing nip formed by the fixing film and the pressure roller becomes excessively wide, unfavorable for the slippage of the recording material.

On the other hand, in case the rubber hardness is excessively high, the parting layer **30*c*** has to be made thinner in order to obtain a pressure roller of a desired product hardness, but the parting layer tends to cause wrinkles or breakage because of poor durability. Also in case the product hardness is excessively high, the fixing nip width is reduced and the fixing ability is deteriorated.

The fixing nip portion N between the fixing film 10 and the pressure roller 30 preferably has a linear pressure within a range of 60 to 180 g/mm.

In case the linear pressure is excessively low, the driving force for the fixing film 10 by the pressure roller 30 becomes deficient, thereby tending to cause slippage of the recording material. On the other hand, in case the linear pressure is excessively high, sticking and slipping are generated at the sliding portion between the internal surface of the fixing film and the film guide member, thereby causing an image defect.

The generation of slipping was observed by employing smooth papers of a letter size, let to stand for 24 hours or more in an environment of a temperature of 30° C. and a humidity of 80%, rotating the pressure roller at 30 mm/sec and passing 100 sheets of paper intermittently. The observation was conducted with the pressure rollers and the fixing apparatus of the present embodiment in an unused state and a state after continuous passing 200,000 sheets, but the slippage was not observed in either fixing apparatus.

On the other hand, in a fixing apparatus employing a conventional pressure roller in which the entire elastic layer is covered with the parting layer **30*c* and which is not provided with the elastomer layer exposed portion 32, after a durability test of passing 200,000 sheets, grease inside the fixing film is thermally deteriorated to increase the driving torque of the pressure roller, also the fixing nip becomes wider by the deterioration of the elastomer layer 30***b* and the friction coefficient of the surface of the pressure roller 30 is lowered by the deterioration of the parting layer 30*c*, whereby the rate of slippage generation becomes very high.

Also, even in a fixing apparatus prior to the durability test, as the temperature of the pressure roller is elevated by the sheet passing, the slipping may be generated easily as the amount of vapor generated from the paper increases.

Therefore, as explained in the foregoing, in the fixing apparatus of the present embodiment employing the pressure roller 30 which is provided in the sheet non-passing area with a portion where the elastomer layer 30*b* is exposed and in which the maximum value of the external diameter of the elastomer layer exposed portion 32 is equal to or larger than the maximum value of the external diameter of the parting layer portion 31 of the pressure roller 30, since there can be obtained a high conveying power for the fixing film 10 by the pressure roller 30, there can be obtained a pressure roller with stable sheet conveying ability and without slippage even in case a material of satisfactory pating ability such as PFA in the surface layer of the pressure roller 30 and of the fixing film 10.

(Second Embodiment)

In the following there will be explained a second embodiment of the present invention. In the following, configurations similar to those in the first embodiment will be represented by same symbols and will not be explained further.

Figure 11:
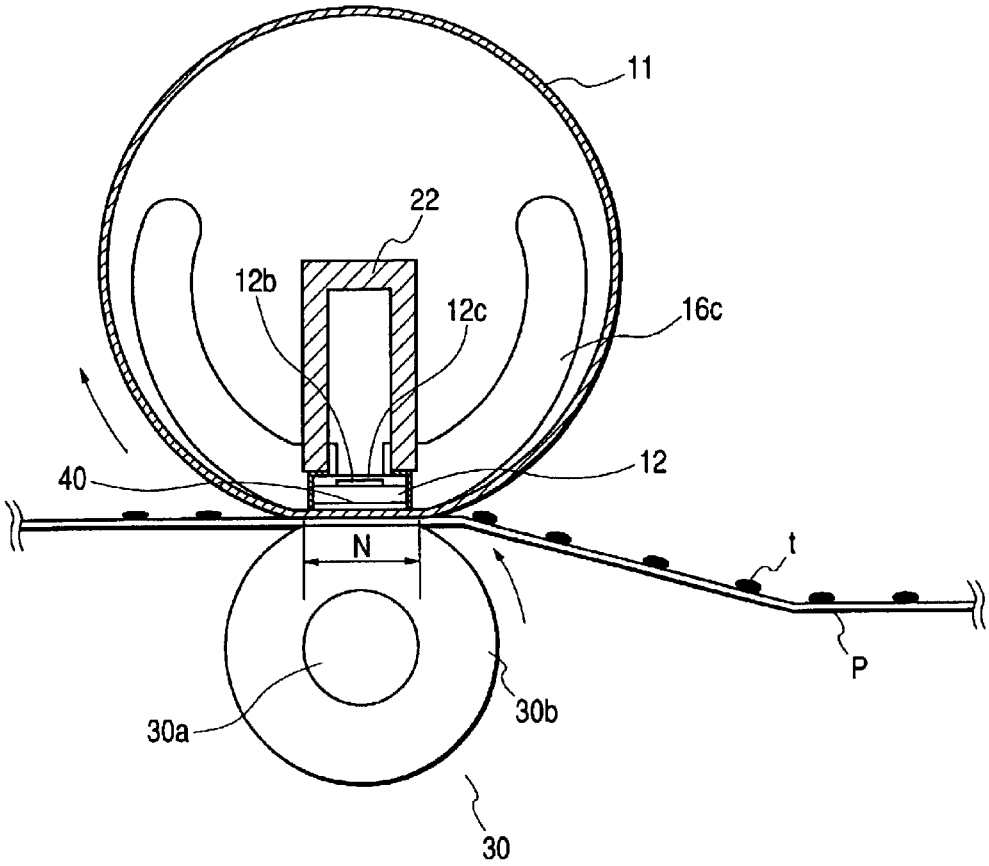
FIG. 11 is a schematic cross-sectional view showing the configuration of an image heating apparatus in a second embodiment of the present invention.

FIG. 11 is a schematic cross-sectional view showing the configuration of principal parts of the image heating apparatus of the present embodiment.

In the image heating apparatus of the present embodiment, as shown in FIG. 11, a film guide 16*c* constituting a heat-resistant and heat-insulating support member of a trough shape, having an approximately semi-circular cross section, is provided at the approximate center of a lower surface thereof with a groove formed along the longitudinal direction of the film guide 16*c*, and a ceramic heater 12 constituting a heating body is fitted in such groove and fixed therein. In the present embodiment, the ceramic heater 12 corresponds to the sliding member. A protective glass layer 40 is provided on the ceramic heater 12.

A fixing film 11, constituting a heat-resistant flexible rotary body of a cylindrical or endless shape, is loosely fitted about the film guide 16*c*.

In the image heating apparatus of the present embodiment, the fixing film 11 is not provided with the heat generating property by electromagnetic induction, and is formed by coating a seamless polyimide film base of a thickness of 50 $\mu$m with a parting layer of fluorinated resin or the like with a thickness of about 20 $\mu$m.

A pressurizing rigid stay 22 is inserted inside the film guide 16*c*.

The pressurizing means for forming the fixing nip portion N and the means for holding end portions of the fixing film are similar to those in the first embodiment and will not be explained further.

The pressure roller 30 is rotated by drive means M counterclockwise as indicated by an arrow. A frictional force between the pressure roller 30 and the fixing film 11 under the rotary drive of the pressure roller 30 applies a rotating force to the fixing film 11, whereby the fixing film 11 rotates clockwise, with the internal surface thereof sliding in contact with the lower sliding surface of the ceramic heater 12 in the fixing nip portion N, around the film guide member 16*c* with a peripheral speed approximately corresponding to the rotating speed of the pressure roller 30. The fixing film 11 is binded or pinched by the ceramic heater 12 and the pressure roller 30.

Also in the present embodiment, it is possible prevent slippage of the recording material by employing a pressure roller of a configuration similar to that in the first embodiment. The apparatus of such film heating type is not provided with the heat generating layer by electromagnetic induction in the film, thereby allowing to use a resinous film of low thermal deterioration, to use a ceramic heater or an electromagnetic induction heater of a low heat capacity and to use a thin heat-resistant material of a low heat capacity for the film, whereby obtained are such advantages as a significant saving in the electric power, a reduction in the wait time, a quick start performance and a reduced temperature elevation in the apparatus, in comparison with an apparatus of heat roller type employing a fixing roller of a large heat capacity.

(Third Embodiment)

In the following there will be explained a third embodiment of the present invention. In the following, configurations similar to those in the first embodiment or in the second embodiment will be represented by same symbols and will not be explained further.

As the parting layer portion 31 and the elastomer layer exposed portion 32 have significantly different conveying forces for the fixing film 11, a torsion force is generated therein. Consequently, in case a resinous film is employed as in the fixing apparatus of the second embodiment, the durability may be sufficient in a fixing apparatus of a low speed and a low load but will become insufficient in a fixing apparatus of a high speed and a high load.

The configuration of the present embodiment is similar to that of the second embodiment, except that an elastomer layer is provided between the polyimide base layer of the fixing film 11 and the parting layer thereof.

In the present embodiment, the elastomer layer is formed by heat-resistant silicone rubber.

Presence of the elastomer layer between the base layer and the parting layer of the fixing film 11 increases the strength of the fixing film 11, and, owing to the elasticity of the elastomer layer, there can be absorbed the torsion force generated in the fixing film 11 in the conveying thereof by the pressure roller 30. Also the adaptability of the fixing 11 to the recording material and the toner layer increases, thereby allowing to obtain a satisfactory image without unevenness in the image gloss.

(Fourth Embodiment)

In the following there will be explained a fourth embodiment of the present invention. In the following, configurations similar to those in the first to third embodiments will be represented by same symbols and will not be explained further.

The configuration of the present embodiment is similar to that of the fixing apparatus, employing a plate-shaped heater as in the second or third embodiment, except that a metal is employed in the base layer of the fixing film 11.

The use of a metal film of a higher strength as the base layer of the fixing film 11 increases the rigidity of the fixing film 11, whereby the fixing film 11 is hard to break even in case a large torsion force is generated therein. Therefore, the fixing film 11 of the present embodiment is suitable for a fixing apparatus of a high speed and a high load.

In case of employing a metal film as the base layer, it is preferable to provide a resin layer such as of polyimide as a sliding layer on the internal surface of the fixing film 11.

Also by the use of a fixing film including a metal film of a high thermal conductivity as the base layer, there is obtained an advantage of efficiently transmitting the heat, generated by the heat generating body (plate-shaped heater) to the paper, and the present embodiment is suitable also in this point for a high-speed printer in which the temperature of the fixing film tends to lower in a continuous printing operation. The metal to be employed is preferably nickel or stainless steel.

In the fixing film capable of heat generation by electromagnetic induction, employed in the first embodiment, the elastic layer 2 may be dispensed with in case of use in a heat fixing device for a monochromatic printer or a one-pass multi-color printer. Also the heat generating layer 1 may formed by mixing a metal filler in a resin. Further, the fixing film may be formed as a single-layered member of a heat generating layer only.

The image heating apparatus of the present invention is not only applicable to the fixing apparatus described in the foregoing first to fourth embodiments, but also to an image heating apparatus for heating a recording material bearing an image to improve surface properties such as luster, an image heating apparatus for temporary image fixation, and other various apparatus for heating various materials to be heated, such as a heat drying apparatus for such materials or a heat laminating apparatus.

The present invention relates to an image heating apparatus of a configuration in which a flexible rotary body is rotated by the rotation of an elastic roller, regardless of the image heating process. Also, the present invention is not limited to the aforementioned embodiments but is subject to various modifications within the technical scope of the invention.

What is claimed is:

1. An image heating apparatus for heating an image formed on a recording material, comprising:

a flexible rotary body;

a sliding member, provided in the interior of the flexible rotary body, for contacting the flexible rotary body; and an elastic roller for forming a nip portion for pinching and conveying the recording material, in cooperation with the sliding member and across said rotary body, the elastic roller including an elastic layer and a parting surface layer;

wherein a whole area that a recording material passes in the nip portion is within an area of the parting surface layer, while an area that a recording material does not pass in the nip portion includes an exposed area where the elastic layer of the elastic roller is exposed, wherein the exposed area includes a portion where a diameter gradually increases toward an end portion of the elastic roller, and wherein a maximum diameter of the exposed area is equal to or larger than a maximum diameter of the area of the parting surface layer.

2. An image heating apparatus according to claim 1, wherein the exposed area has a surface friction coefficient larger than a surface friction of the parting surface layer.

3. An image heating apparatus according to claim 1, wherein a maximum diameter d1 of the area of the parting surface layer and a maximum diameter d2 of the exposed area satisfy a condition of $0 \leqq (d2-d1)/d1 \leqq 0.2$.

4. An image heating apparatus according to claim 1, wherein the elastic layer has an Asker-C hardness (under a load of 9.8 N) within a range from 25° to 60°.

5. An image heating apparatus according to claim 1, wherein the rotary body includes an elastic layer.

6. An image heating apparatus according to claim 1, wherein the rotary body includes a heat generating layer.

7. An image heating apparatus according to claim 1, wherein the sliding member includes a heat generating portion.

8. An elastic roller for use in an image heating apparatus including a nip portion for pinching and conveying a recording material bearing an image, comprising:

an elastic layer; and a parting surface layer;

wherein a whole area that a recording material passes in the nip portion is within an area of the parting surface layer, while an area that a recording material does not pass in the nip portion includes an area where the elastic layer of the elastic roller is exposed, wherein the exposed area includes a portion where a diameter gradually increases toward an end portion of the elastic roller, and wherein a maximum diameter of the exposed area is equal to or larger than a maximum diameter of the area of the parting surface layer.

9. An elastic roller according to claim 8, wherein the exposed area has a surface friction coefficient larger than a surface friction of said parting surface layer.

10. An elastic roller according to claim 8, wherein a maximum diameter d1 of the area of the parting surface layer and a maximum diameter d2 of the exposed area satisfy a condition of $0 \leqq (d2-d1)/d1 \leqq 0.2$.

11. An elastic roller according to claim 8, wherein the elastic layer has an Asker-C hardness (under a load of 9.8 N) within a range of 25° to 60°.

12. An image heating apparatus for heating an image formed on a recording material, comprising:

a flexible rotary body;

a sliding member provided in the interior of the flexible rotary body, for contacting therewith; and an elastic roller for forming a nip portion for pinching and conveying the recording material, in cooperation with the sliding member and across the rotary body, the elastic roller including an elastic layer and a parting surface layer;

wherein an area which is not passed by the recording material in the nip portion includes an area where the elastic layer of the elastic roller is exposed, wherein the exposed area includes a portion where a diameter gradually increases toward an end portion of the elastic roller, and wherein a maximum diameter d1 of the area where the parting surface layer is provided and a maximum diameter d2 of the exposed area satisfy a condition of $0 \leqq (d2-d1)/d1 \leqq 0.2$.

13. An image heating apparatus according to claim 12, wherein the exposed area has a surface friction coefficient larger than a surface friction of said parting surface layer.

14. An image heating apparatus according to claim 13, wherein the elastic layer has an Asker-C hardness (under a load of 9.8 N) within a range from 25° to 60°.

15. An image heating apparatus according to claim 13, wherein the rotary body includes an elastic layer.

16. An image heating apparatus according to claim 13, wherein the rotary body includes a heat generating layer.

17. An image heating apparatus according to claim 13, wherein the sliding member includes a heat generating portion.

18. An elastic roller for use in an image heating apparatus including a nip portion for binding and conveying a recording material bearing an image, comprising:

an elastic layer; and a parting surface layer;

wherein an area which is not passed by the recording material in the nip portion includes an area where the elastic layer of the elastic roller is exposed, and the exposed area includes a portion where a diameter gradually increases toward an end portion of said elastic roller, and wherein a maximum diameter d1 of the area where the parting surface layer is provided and a maximum diameter d2 of the exposed area satisfy a condition of $0 \leqq (d2-d1)/d1 \leqq 0.2$.

19. An elastic roller according to claim 18, wherein the exposed area has a surface friction coefficient larger than a surface friction of said parting surface layer.

20. An elastic roller according to claim 19, wherein said elastic layer has an Asker-C hardness (under a load of 9.8 N) within a range from 25° to 60°.

* * * * *

UNITED STATES PATENT AND TRADEMARK OFFICE

CERTIFICATE OF CORRECTION

PATENT NO. : 6,792,240 B2
DATED : September 14, 2002
INVENTOR(S) : Tomonori Shida et al.

It is certified that error appears in the above-identified patent and that said Letters Patent is hereby corrected as shown below:

Title page,
Item [57], ABSTRACT,
Line 5, "a" (1st and 2nd occurrence) should read -- an --.

Column 2,
Line 50, "provide" should read -- to provide --.

Column 6,
Line 51, "ρ[χm]." should read -- ρ[Ωm]. --.

Column 7,
Line 19, "following" should read -- follow --.

Column 12,
Line 6, "possible" should read -- possible to --.

Column 13,
Line 7, "to lower" should read -- to be lower --.
Line 13, "may" should read -- may be --.

Signed and Sealed this

Twenty-first Day of December, 2004

JON W. DUDAS
*Director of the United States Patent and Trademark Office*